US005738254A

United States Patent [19]

de la Guardia

[11] Patent Number: 5,738,254

[45] Date of Patent: Apr. 14, 1998

[54] REPRESSURIZING BEVERAGE DISPENSER FOR ATTACHMENT TO CARBONATED BEVERAGE BOTTLES

[76] Inventor: Mario F. de la Guardia, 13211 SW. 39 Ter., Miami, Fla. 33175

[21] Appl. No.: 696,350

[22] Filed: Aug. 13, 1996

[51] Int. Cl.[6] ..... B65D 83/00

[52] U.S. Cl. ..... 222/400.8; 222/401

[58] Field of Search ..... 222/400.7, 400.8, 222/401, 556

[56] References Cited

U.S. PATENT DOCUMENTS

| | | | |
|---|---|---|---|
| 1,445,643 | 2/1923 | Peron | 222/400.8 |
| 1,460,208 | 6/1923 | Mohn | 222/400.8 |
| 1,679,104 | 7/1928 | Trautman | 222/400.8 |
| 4,606,477 | 8/1986 | Spengler et al. | 222/400.8 |
| 5,595,208 | 1/1997 | Augustinus et al. | 222/400.7 |
| 5,607,084 | 3/1997 | George | 222/400.7 |

*Primary Examiner*—Joseph Kaufman

[57] ABSTRACT

A repressurizing dispenser for removable attachment to the threaded neck of a carbonated beverage container includes a housing having an integrally formed handle and a hollow collar with a threaded seal ring therein for threaded engagement with the neck of the container and including a central opening in alignment with the discharge opening of the container. A bulb hand operated air pump is fitted within the handle and interconnects to the seal ring to permit introduction of air into the container's interior. A valve includes a half ball-shaped member and a through passage. The valve is movable between a closed position, wherein the half ball-shaped member is disposed in blocking, sealed engagement with the central opening of the seal ring, and an open position wherein the through passage is aligned with the central opening and discharge opening of the container, thereby permitting dispensing of the contents in the container.

7 Claims, 4 Drawing Sheets

REPRESSURIZING BEVERAGE DISPENSER FOR ATTACHMENT TO CARBONATED BEVERAGE BOTTLES

BACKGROUND OF THE INVENTION

1. Field of the Invention

This invention relates to repressurizing devices for beverage containers, and particularly to a repressurizing dispenser adapted for removable attachment to the threaded neck of a conventional carbonated beverage container; the dispenser including a handle, a valve, and a pump.

2. Description of the Related Art

Some beverages are impregnated with carbon dioxide gas in order to provide a refreshing effervescence which has a pleasant appeal when consuming the beverage. Some carbonated beverages are sold in two or three liter beverage containers in order to cost per ounce to the consumer. While many people find these larger size beverage containers to be more desirable than cans, because they can be recapped and stored if the beverage is not entirely consumed after opening, they do present some problems to the user. In particular, it is well-known that carbon dioxide gas has the tendency to escape into the atmosphere if the beverage is not contained under pressure. Because a closed beverage bottle, when half full, contains a large sealed open air space, the carbon dioxide in the beverage is able to escape into this open space even when the cap is tightly secured to the bottle. Once the cap is removed, the carbon dioxide in this space releases into the atmosphere. When carbon dioxide escapes from a carbonated beverage, the desirable sparkling effervescence is lost and cannot be replaced. Once this happens, the carbonated beverage becomes flat, leaving an undesirable taste with no refreshing appeal to the consumer. In this instance, the carbonated beverage will most likely be discarded or thrown away, thereby effectively increasing the cost per used ounce to the consumer. This certainly defeats the primary purpose of larger beverage containers, which is to provide a greater volume of product to the consumer at a lower cost per ounce.

Pumping devices have been proposed for pressurizing the open volume within a carbonated beverage bottle with ambient air. It is also known to combine a closure cap and pressurizing pump for insertion into the neck of a beverage container. U.S. Pat. No. 718,163 to Sherrard (1903) discloses a bottle tap for corked bottles. Air pressure is created in order to facilitate the discharge of the liquid therefrom. U.S. Pat. No. 2,853,207 to Yingst (1954) discloses a device for dispensing liquids. Both Sherrard's invention and Yingst's invention function to dispense a liquid from a bottle through a narrow tube which is inserted into the bottle. Neither the Sherrard device, nor the Yingst device, is suited to fit a two liter carbonated beverage bottle.

The Ballas U.S. Pat. No. 4,768,665, discloses a hand operated pump which uses a cylinder and piston. The Ballas pump is attachable to a threaded bottle neck. Likewise, U.S. Pat. No. 4,723,670 to Robinson discloses a hand operated pump which attaches to a threaded bottle neck and which uses a cylinder and piston. Both Ballas and Robinson require removal of the device from the bottle prior to pouring the contents of the bottle into a glass or other receptacle. In addition, the size of the piston pump in Robinson is small, requiring a large number of repeated pumping strokes by the operator in order to complete repressurizing of the beverage bottle.

OBJECTS AND ADVANTAGES OF THE INVENTION

It is a principal object of the present invention to provide an improved beverage dispenser and repressurizing device for removable attachment to a beverage bottle and including a pump, a handle, and a valve which is structured to permit dispensing, sealing and repressurizing of a beverage container in a rapid, efficient manner requiring minimal effort.

Another object of the invention is to provide a repressurizing beverage dispenser for removable attachment to the threaded neck of a beverage bottle, wherein the dispenser includes a valve with a half ball-shaped member which is structured to create a seal and to increase its resistance to air pressure release as the bottle is rotated to tighten the dispenser onto the threaded neck of the bottle.

A further object of the invention is to provide a beverage dispenser with a valve having a half ball-shaped member and a built -in lever which extends outward from a front of the dispenser, enabling the valve to be opened and closed by either a right-handed or a left-handed operator.

A further object of the invention is to provide an improved beverage dispenser, as set forth above, and including a built-in lever for operating the valve, and wherein the lever acts as a counterweight opposite of the handle so that when the dispenser is attached to a bottle, the counterweight lever will maintain the bottle balanced so that it does not tip over.

It is yet another object of the present invention to provide a valve having a half ball-shaped member and a through passage having a diameter approximately equal to the diameter of the discharge opening of a beverage container in order to ensure rapid flow of liquid from within the beverage container and through the dispenser.

It is still a further object of the present invention to provide a dispenser having a handle and a built-in, hand operated, bulb style air pump.

It is still another object of the present invention to provide a dispenser, as set forth above, and including a spray guard structured to prevent the user from getting sprayed with air from the back of the dispenser, when opening the valve, due to excessive build up of air pressure within the beverage bottle.

It is yet another object of the present invention to provide a beverage dispenser with a pump, handle, and valve combination which, when attached to a two liter beverage bottle, will not add appreciable height to the overall assembly.

SUMMARY OF THE INVENTION

A dispenser includes a housing having an integrally formed handle and a hollow collar. The housing includes a hand operated bulb style air pump fitted within the handle and interconnected to a threaded seal ring within the hollow collar for introducing air into the open interior space of a carbonated beverage bottle when the device is attached thereto.

The dispenser includes a valve having a half-shaped ball member and a through passage. The valve is movable between a closed position to seal the bottle so that it can be pressurized, and an open position to permit dispensing of the liquid contained therein.

The seal ring includes thread means structured for threaded, mating engagement with the threaded neck of the beverage bottle. A central opening of the seal ring aligns with the discharge opening of the beverage bottle. The ball-shaped element of the valve moves within a dish-shaped seat on an upper side of the seal ring into and out of blocking relation to the central opening to thereby define the open and closed valve positions.

When the dispenser is threadably fastened to the neck of the beverage bottle, air is pumped into the bottle by squeezing the hand operated air pump on the handle of the housing. The half ball-shaped valve member, when in the closed position, holds the added air pressure within the bottle. When the half ball-shaped valve member is moved to the open position, the added air is released from the bottle. With the valve in the open position, the carbonated beverage may be poured from the bottle by tilting the bottle so that the neck is angled downwardly, thus allowing the beverage contents to flow through the passage of the valve which aligns with the discharge opening of the container and the central opening of the seal ring.

The ball-shaped valve member increases its sealing pressure as the bottle is rotated to threadably engage and tighten the dispenser on the neck of the bottle. As the bottle rotates, the threads carry the bottle neck upward and into the hollow collar of the dispenser housing, in threaded engagement with the thread means on the seal ring, until the rim surrounding discharge opening of the bottle makes air tight contact with the bottom of the seal ring. Continued rotation, when tightening the dispenser on the bottle, forces the seal ring upward, causing the top dish-shaped seat of the seal ring to make air tight contact with the half ball-shaped valve member. In this manner, the seal ring becomes sandwiched between the half ball-shaped valve member and the rim of the bottle, creating a reliable air tight connection between the dispenser and the bottle and preventing dissipation of the pressurized air contents therein.

The valve includes a lever which is integrally formed with the half ball-shaped member and extends outwardly from a front of the dispenser housing in partially surrounding relation to the through passage of the valve. The lever is used to close and open the valve. A right-handed or a left-handed person can easily open or close the valve by grasping the lever and moving it through an arc of approximately 90°. To open the valve, the lever is pulled back so that it points upwardly. To close the valve, the lever is pushed forward so that it is generally horizontal to the table surface when the beverage bottle is standing upright thereon. With the dispenser attached to the bottle in the upright position, the lever acts as a counterweight to the handle, to keep the bottle balanced so that it will not tip over.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
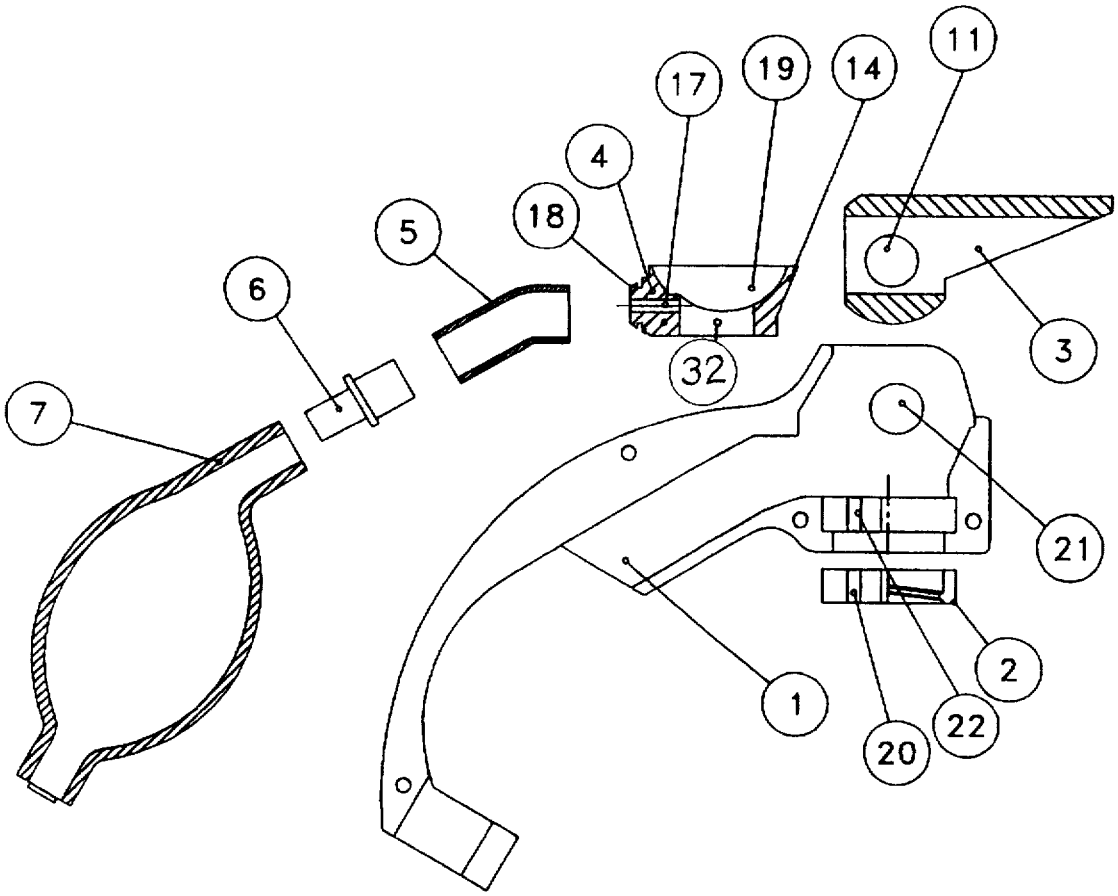
FIG. 1 is an exploded view, in partial section, illustrating the component elements of the dispenser of the present invention.

In the description which follows, like parts are indicated throughout the specification and drawings with the same reference numerals, respectively. The drawings are not necessarily to scale and the proportions of certain parts have been exaggerated to better illustrate operation of the invention.

Figure 3:
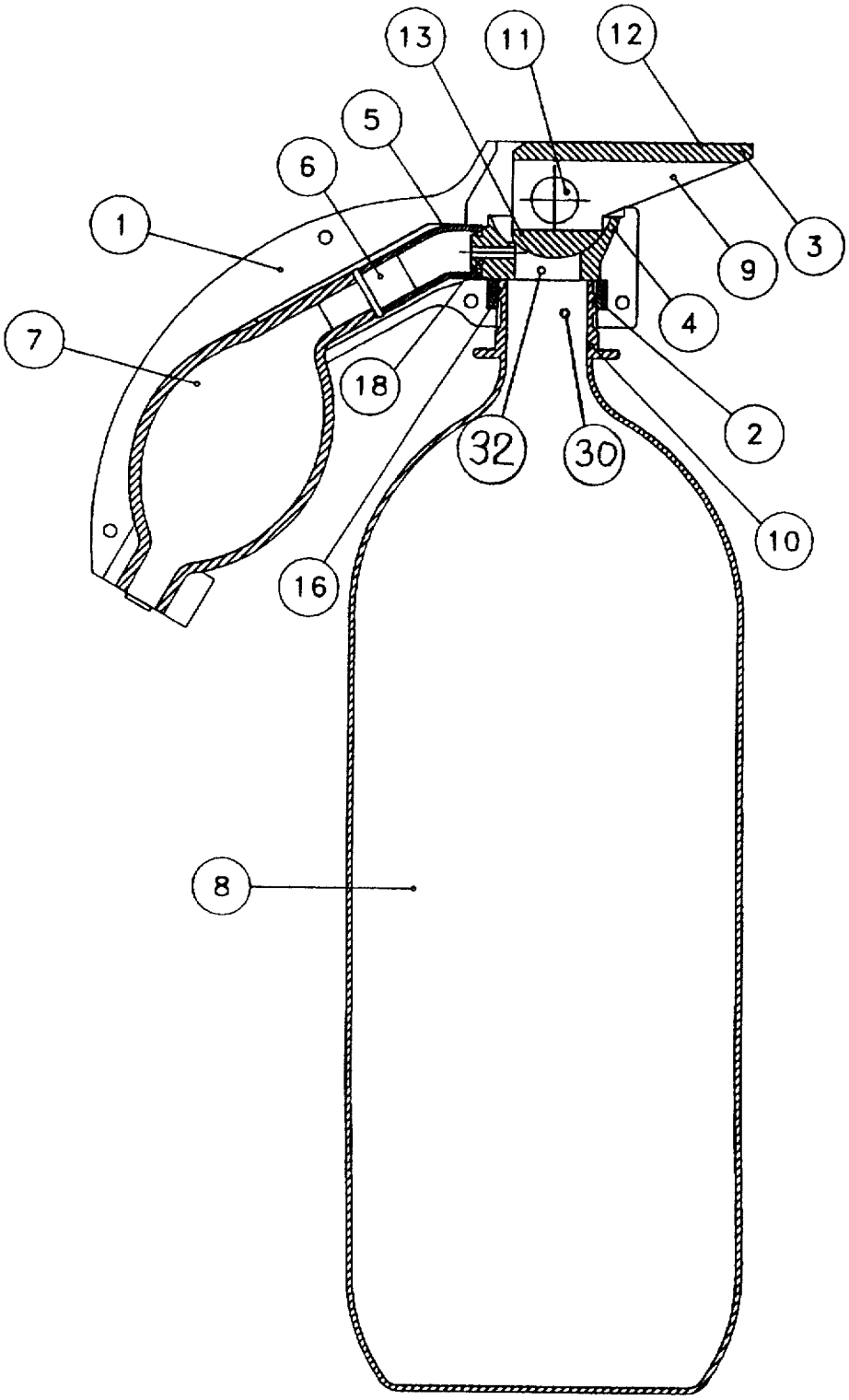
FIG. 3 is a side elevational view, in section, showing the dispenser fitted to the threaded neck of a carbonated beverage bottle showing the valve means in a closed position.
Figure 4:
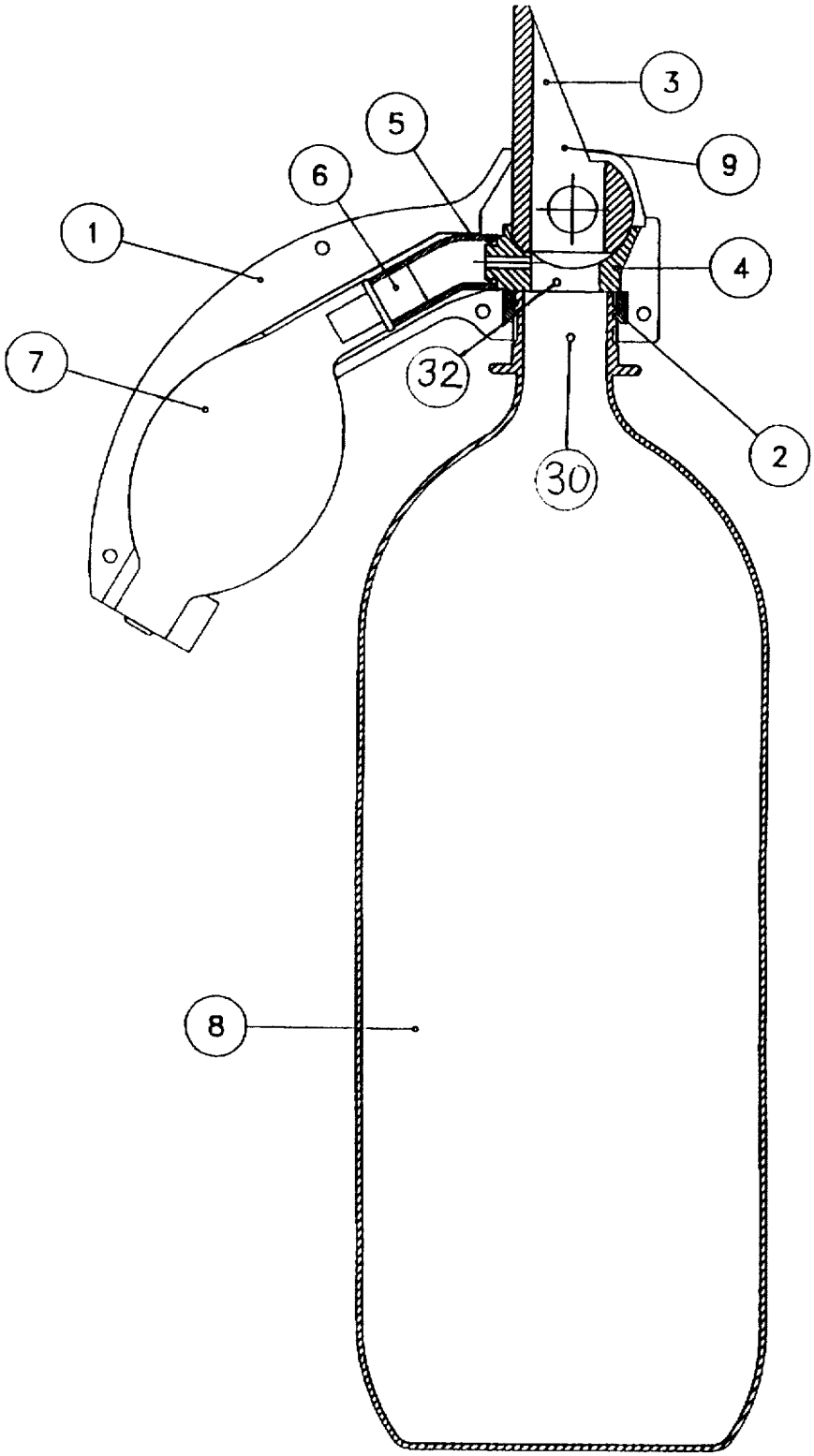
FIG. 4 is a side elevational view, in section, illustrating the dispenser fitted to a carbonated beverage bottle, with the valve means in an open position.

In FIG. 3, a half ball valve 3, is combined with a sealing ring 4, a pump 7, a threaded ring 2, and enclosed in a housing 1, which has the shape of a handle. The half ball valve 3 has a through passage having a diameter generally equal to the diameter of the rim 16 of the bottle neck 10 discharge opening 30. Dual opposing cylindrically shaped appendages 11 are located on the left and right side of half ball valve 3. At the top of the half ball valve 3, a lever extends to the front in the shape of a flat rectangle 12. A half sphere shape 13 is located at the bottom of the half ball valve 3.

A sealing ring 4 includes a dish-shaped concave valve seat 19 positioned directly under the half ball valve 3. As seen in FIG. 1, sealing ring 4 includes a central opening 32. The dish-shaped valve seat 19 forms an air tight seal when coming into contact with the half sphere 13 (FIG. 3) of the half ball valve 3. In FIG. 1, the bottom rim of the sealing ring 4 is flat and forms an air tight seal when coming into contact with the rim 16 of a bottle neck 10 (FIG. 3). In FIG. 1, a perforation 17 in the side wall 14 of the sealing ring 4 leads out to a short external tube shaped barbed fitting 18. The barbed fitting 18 is permanently attached to the sealing ring 4. In FIG. 3, a short flexible tube 5 is attached to the barbed fitting 18 of the sealing ring 4. The opposite end of the flexible tube 5 is attached to the check valve 6 of a bulb hand air pump 7. Another embodiment would permanently combine barbed fitting 4 with tube 5 in order to form one whole piece. In FIG. 3, a female threaded ring 2 is located directly under sealing ring 4. In FIG. 1, female threaded ring 2 has exterior grooves 20 which cover the outside circumference.

The components mentioned above are enclosed in a housing 1. Housing 1 is divided into two parts, the left and right part. In FIG. 1, there is a perforation 21, located on the side wall near the top of housing 1. Left and right appendage 11 of the half ball 3 fit within left and right perforation 21. Half ball valve 3 can swivel in a 90° rotation when fitted between the left and right housing 1 and when housing 1 is put together.

Figure 2:
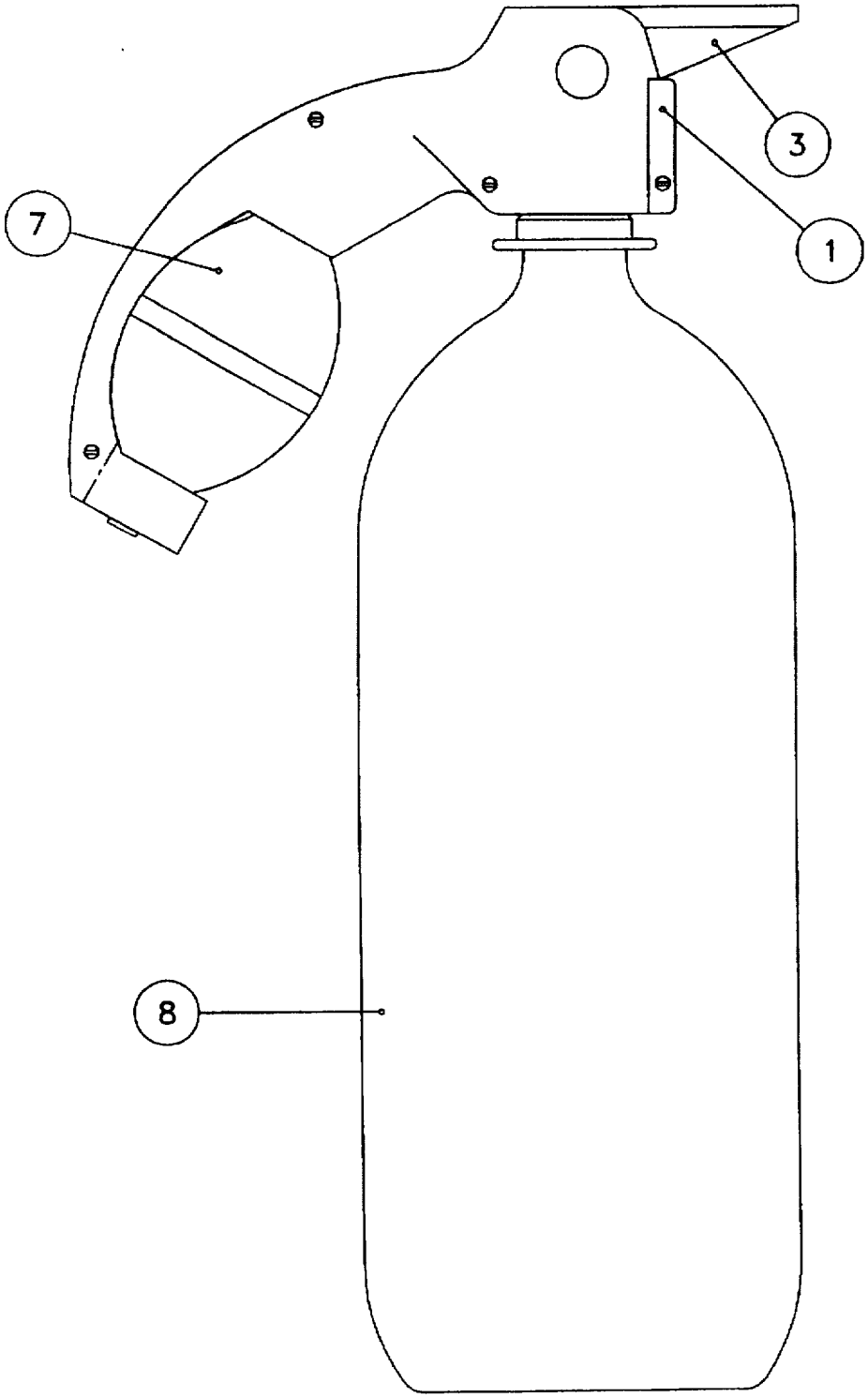
FIG. 2 is a side elevational view showing the dispenser fitted to a carbonated beverage bottle.

In FIG. 3, sealing ring 4, tube 5 and air pump 7 are also held in place within the housing 1. When the left and right parts of housing 1 are put together, housing 1 acts as a clamp for air tight connection between tube 5, barbed fitting 18, and check valve 6. In FIG. 1, exterior grooves 20 of threaded ring 2 function in conjunction with interior grooves 22 located within and at the bottom of housing 1. When the left and right parts of housing 1 are put together, threaded ring 2 will fit firmly between the left and right parts of housing 1. In FIG. 2, housing 1 forms the shape of a handle.

What is claimed is:

1. A pressurizing dispenser device for removable attachment to a carbonated beverage bottle to the type including a threaded neck surrounding a discharge opening in fluid communication with an interior storage chamber, said device comprising:

a housing including an integrally formed handle and a hollow collar, thread means within said collar for threaded engagement with the threaded neck of the bottle, seal means within said collar for providing an air tight seal when said device is attached to the neck of the bottle, said seal means including a through aperture disposed in alignment with the discharge opening of the bottle, manually operated pump means on said handle for introducing air into said interior storage chamber of said bottle, air delivery means interconnecting to said pump means for directing air flow from said pump means to said interior storage chamber of said bottle, and a valve including:

a half ball-shaped member movably fitted within said housing adjacent to said seal means, a through passage structured and disposed to permit flow of contents of the bottle therethrough, a lever extending from the half ball-shaped member to facilitate movement of the valve between a closed position and an open position, and wherein said closed position is defined by said half ball-shaped member disposed in blocking relation to the through opening of the seal means to prevent release of air and liquid from within the interior chamber of the bottle, and wherein the open position is defined by said through passage of said valve disposed in axial alignment with said through opening of said seal means and the discharge opening of the bottle, thereby permitting discharge of the contents of the bottle.

2. A device as recited in claim 1 wherein said thread means includes a ring fitted within said collar and including a threaded annular inner surface adapted for threaded engagement with the threaded neck of the bottle.

3. A device as recited in claim 1 wherein said seal means includes a seal ring having a perforation in a side wall thereof for interconnection with said pump means and at least partially defining said air passage means.

4. A device as recited in claim 3 wherein said air passage means further includes a flexible tube interconnecting in air flow communication between said seal ring and said pump means.

5. A device as recited in claim 4 wherein said pump means includes a bulb type hand operated pump.

6. A device as recited in claim 5 wherein said pump means further includes a check valve to permit one-way passage of air flow from said bulb type hand pump to said perforation in said seal ring for delivery of air into the interior storage chamber of the bottle.

7. A device as recited in claim 1 wherein said seal ring includes a dish-shaped valve seat surrounding said central opening and being structured to accommodate movement of said half ball-shaped member therein into and out of blocking relation to said central aperture.

* * * * *